US006659170B1

(12) United States Patent
Kale

(10) Patent No.: US 6,659,170 B1
(45) Date of Patent: Dec. 9, 2003

(54) ENERGY-EFFICIENT, FINNED-COIL HEAT EXCHANGER

(76) Inventor: Hemant D. Kale, 8253 Sugarland Dr., Manlius, NY (US) 13104

( * ) Notice: Subject to any disclaimer, the term of this patent is extended or adjusted under 35 U.S.C. 154(b) by 538 days.

(21) Appl. No.: 09/553,460

(22) Filed: Apr. 19, 2000

Related U.S. Application Data

(63) Continuation-in-part of application No. 09/126,981, filed on Jul. 31, 1998, now abandoned, which is a continuation of application No. 08/664,397, filed on Jun. 17, 1996, now abandoned.

(51) Int. Cl.[7] ..... F28D 1/047
(52) U.S. Cl. ..... 165/122; 165/151
(58) Field of Search ..... 165/122, 151

(56) References Cited

U.S. PATENT DOCUMENTS

| | | | |
|---|---|---|---|
| 1,790,535 | A | 1/1931 | Coe |
| 1,914,197 | A | 6/1933 | Davis, Jr. et al. |
| 2,401,918 | A | 6/1946 | Elder et al. |
| 2,437,452 | A | 3/1948 | Baird |
| 2,705,877 | A | 4/1955 | King |
| 2,948,515 | A | 8/1960 | Mehalick et al. |
| 3,195,622 | A | 7/1965 | Haufler et al. |
| 3,263,749 | A | 8/1966 | Dormitzer |
| 3,985,295 | A | 10/1976 | Monninger |
| 4,483,392 | A | 11/1984 | Korsmo et al. |
| 4,966,230 | A | 10/1990 | Hughes et al. |
| 5,588,484 | A | 12/1996 | Baker et al. |

FOREIGN PATENT DOCUMENTS

| | | |
|---|---|---|
| DE | 1405364 | 9/1969 |
| JP | 56-3834 | 1/1981 |

OTHER PUBLICATIONS

Fraas et al., "Heat Exchanger Design", copyright 1965 by John Wiley and Sons, selected portions cited (pps. 9, 26, 174–189, 328,329).*

* cited by examiner

*Primary Examiner*—Allen Flanigan
(74) *Attorney, Agent, or Firm*—John C. Shepard

(57) ABSTRACT

A finned-coil heat exchanger has a housing with spaced walls defining an internal chamber with air flowing from an upstream end to a downstream end, spaced transfer tubes with heat conducting media flowing therein from the downstream chamber end to the upstream chamber end, a series of spaced fins in contact with the tubes to transfer heat to flowing air, and a fan unit to move air through the exchanger. An air inlet is defined at the upstream end of the housing or in the lower end of one of the walls so that air can enter the internal chamber. The tubes each extend tortuously back and forth on a plane parallel to the direction of air flow so that there is a counterflow effect across the various segments of each tube. The tubes have at least six segments extending transversely across air flow with the tubes and fins being sized and spaced to provide for better air flow through the heat exchanger housing.

4 Claims, 4 Drawing Sheets

ENERGY-EFFICIENT, FINNED-COIL HEAT EXCHANGER

CROSS-REFERENCE TO RELATED APPLICATION

This application is a continuation-in-part of my prior copending U.S. patent application Ser. No. 09/126,981, filed Jul. 31, 1998 now abandoned, which was a continuation of U.S. patent application Ser. No. 08/664,397 filed Jun. 17, 1996, which application is now abandoned.

BACKGROUND OF THE INVENTION

1. Technical Field

This invention relates generally to heat exchangers and, more particularly, to a heat rejecting refrigerant-to-air finned coil heat exchanger used as a condenser in refrigeration and air conditioning devices.

2. Background Art

Heat transfer is a function of available temperature difference and of time. The larger the temperature difference, the faster the heat transfer. However, for the same degree of available temperature difference, heat transfer can be increased by allowing longer real time contact between the two heat exchanging media. Complete heat transfer can be assured at all times by allowing an appropriate duration that heat exchanging media stay in contact.

In the prior art, finned-coil heat exchangers using forced air are common. These exchangers always approached the shape of a slab, i.e., a large surface area with a very thin depth. This "slab" is often bent to form a "U-shape". Generally, the length dimension or width dimension or both of the coil surface area is many times greater than the dimension of the depth of the coil, 4 to 20 times or higher. This decreases resistance to the air movement, but enormously reduces the actual time during which cooler air is in contact with the hotter refrigerant tube surface. The short real time contact between the air and the fins results in a much smaller temperature rise being imparted to the cooler air passing over the fins.

In a typical refrigerant cycle, the usual available temperature difference is about 30° F. including the superheat. This is the difference between the temperature of the hot refrigerant fluid entering the heat exchanger and the temperature of the same fluid leaving the exchanger. However, the temperature rise of the air passing over the fins through the heat exchanger is typically only about 10° F., about one-third of the maximum available. That means about three times as much air is being moved as the minimum needed. The larger air quantity being moved means that more energy is being expended to move air.

Another problem with prior art finned-coil heat exchangers is that the general "slab" shape necessitates larger overall volume of the unit. It therefore has a larger footprint, so it occupies more floor space. Since about three times more air is moved than needed, the unit becomes noisier. Additionally, with a large surface area of the coil relative to the sweep of the fan blades, uneven air flow over the coil is created. Because of this, excessive amounts of air pass through the coil surface that is closest to the fan, while the peripheral areas of the coil are starved. That is, no air is moved over the coil portions radially remote from the fan center. This fact means that the full heat transfer capacity of the coil is not being utilized.

In the prior art, the fin density is very high. Typically, heat rejecting condensers use a minimum of 10 fins per inch with 12 to 14 fins per inch being common and 16 fins per inch being the upper limit. The spacing between tubes carrying the fins also has a typical dimension. For instance, the distance between the center lines of tubes having an diameter of ⅜ inch is a maximum of 1 inch; ½-inch tubes, 1.25 inches; and, ⅝-inch tubes, 1.5 inches. In other words, the maximum air space between these tubes is 0.625 inch, 0.750 inch, and 0.875 inch, respectively.

Attempts have been made in the past to increase the air path by moving air along the longer dimension of the cross section of a finned coil. Andreoli U.S. Pat. No. 3,470,947 shows a convector radiator with a monobloc housing wherein ambient air enters from an open bottom, rises through tube fins and exits from the radiator at its upper front corner. Drewes Canada Patent No. 591,553 discloses fins having a large vertical dimension and a smaller depth dimension. Monroe U.S. Pat. No. 3,867,981 employs an angularly sloped flanged fin wherein air is moved across the longer dimension to generate greater heat exchange. While air is moved across the longer side of the fin, no blower is provided to increase air flow. None of these patents show counterflow between the two media needed for efficient heat transfer. These patents also do not show the use of a large number of tube paths needed to purposely create a longer air path.

Umehashi Japan Patent No. 56-3834 shows air path partially along the longer dimension of the finned cross section in an heat absorbing evaporator unit of an air conditioner. Umehashi does not show tubes having a large number of segments transversing air flow necessary to obtain a long air path and good countercurrent (or counterflow) effects. Kormso et al. U.S. Pat. No. 4,483,392 shows air drawn across rows of tubes only three deep. Neither Umehashi nor Kormso show counterflow effects.

Kritzer U.S. Pat. No. 3,151,671 shows a laterally situated blower with air moving along the longer dimension of the finned cross section of a heat radiator employed for comfort heating of indoor space. Kritzer does not show the utilization of transversely spaced multiple tubes to achieve longer path. In heat radiators used for indoor comfort heating applications, it is not essential that complete heat exchange take place by dissipating all heat available in the fluid to the space. In fact, in indoor comfort heating applications, the heat dissipated always varies and gradually lessens as room temperature approaches the thermostat setting. There is nearly always less than complete heat exchange.

Yanadori et al. U.S. Pat. No. 4,333,520 shows air moving along the longer dimension of the finned cross section of an indoor air conditioner unit. Yanadori et al. does not show need for multiple tube paths in an aligned row to obtain long air path for complete heat transfer with minimum air movement and does not show the two media—air and fluid in the tubes—flowing in counterflow directions.

As stated above, it is not essential that there be complete heat transfer between air and the fluid in the tubes of an indoor space heating unit or space cooling unit. For a heat rejecting refrigerant-to-air condenser to be efficient, it is only essential that all heat available in the refrigerant fluid with respect to the ambient temperature be rejected. In an indoor application, it is not desirable that heat transfer take place with minimum air movement. Minimum air movement can cause uncomfortably cold air to emanate from the unit or extremely hot air to blow out of the unit. In extreme situations, this can cause icing of the coil in a cooling mode or a fire hazard in a heating mode. In an indoor space heating unit or space cooling unit application, the heat transfer between the air and the fluid within the tubes continuously varies. It gradually decreases as the space being conditioned approaches the thermostat temperature setting. Air needed to deliver heat or cooling to a distant point in the room must have a small temperature difference from ambient. It can neither be too cold nor too warm so as to become uncomfortable. Both these considerations require that high volumes of air be moved. Yet, complete heat transfer from the tube media should be obtained for maximum efficiency.

SUMMARY OF THE INVENTION

The present invention is directed to overcoming one or more of the problems as set forth above.

According to the present invention, a heat exchanger is provided with a housing having spaced front and back walls and spaced side walls defining an internal chamber area with open lower and upper ends, tubes for conducting hot fluid into the chamber area, a series of spaced fins in contact with the tubes to transfer heat from the tubes to air within the chamber area, the tube segments being spaced transverse to the air path between the two openings located at the opposite ends of the chamber area. The tubes are arranged in rows which are substantially parallel to air flow path with the hot fluid entering the chamber at the air outlet end and traveling through the rows in a counterflow direction with the air so that the multiple tube segments provide a longer air path allowing for longer real time contact between cool air and the hot fins. As a result, more time for heat transfer with minimum air flow is achieved with a reduction in energy consumption.

In an exemplary embodiment of the invention, the housing has a rectilinear configuration, the tubes are routed back and forth through the fins which are oriented parallel to the air flow from a high upstream end to a low downstream end. The fluid flow direction is parallel but opposite to the air flow direction to provide a counterflow effect.

In a preferred embodiment of the invention, each tube is routed back and forth at least 6 times so that at least 6 segments of the tube are connected with air flow across the segments providing a counterflow effect. The tubes and their respective tube segments are spaced apart sufficiently to minimize their resistance to air flow. Further, the fins are spaced apart at a density not exceeding 8 fins per inch to minimize fin resistance to air flow.

A feature of the invention is that air resistance due to longer flow path is reduced by increasing tube spacing. It is noted that for tubes having a diameter not exceeding ¾ inch the spacing between adjacent tube centers should be twice the tube diameter plus at least ½ inch. Increased tube spacing has the advantage of providing a larger fin area per tube with a lesser number of fins. For example, if tube spacing were increased from 1 inch to 2 inches, the available fin area per tube would increase from 1 inch by 1 inch (1 square inch) to 2 inches by 2 inches (4 square inches). By doubling the tube spacing, the fin surface area available per fin per tube would be increased 4 times. Therefore, by doubling the tube spacing, the fins per square inch can be reduced by a factor of 4. Air resistance is drastically reduced by simply increasing tube spacing and reducing fin density. Each of these changes reduces the physical obstruction to air flow and, together, provide for an even greater reduction in obstruction to air flow.

As a general rule, if tube spacing is increased, air resistance is reduced. Experimental tests would indicate that in a heat exchanger having at least 6 tube rows, if the tube spacing were increased to twice the tube diameter plus at least ½ inch but less than ¾ inch, fin densities greater than 8 fins per inch increase air resistance to levels where no advantage can be obtained. However, in the same heat exchanger, if the tube spacing were increased to twice the tube diameter plus at least ¾ inch or more, air resistance is reduced so that fin density can be increased above 8 fins per inch and still provide the benefit of reduced power and increased heat transfer.

An objective of this invention is to alleviate the above mentioned problems associated with prior art fin-tube heat exchangers, namely, higher energy usage due to excessive amounts of air moved, larger overall unit volume, uneven air flow through the exchanger, larger "footprints", and higher levels of noise.

By maintaining longer contact between the cooler air and the hotter fins, most of the heat of the fins can be transferred with a minimum of air flow. A longer path for the air can be achieved by making the air pass over a number of segments of the same fluid containing tube. The increased resistance to the air due to multiple tubes is moderated by the use of less fins or by decreasing their density. The use of a longer air path over a large number of tube bends combined with the principle of complete counterflow and small fin density reduces the energy needed for operation. Further, reducing the face area of the heat exchanger coil relative to the physical size reduces uneven air flow through the coil which would otherwise result in a loss of heat transfer capacity of the heat exchanger.

BRIEF DESCRIPTION OF THE DRAWINGS

The details of construction and operation of the invention are more fully described with reference to the accompanying drawings which form a part hereof and in which like numerals refer to like parts throughout.

In the drawings.

DESCRIPTION OF THE PREFERRED EMBODIMENTS

Best Modes for Carrying Out the Invention

Figure 1:
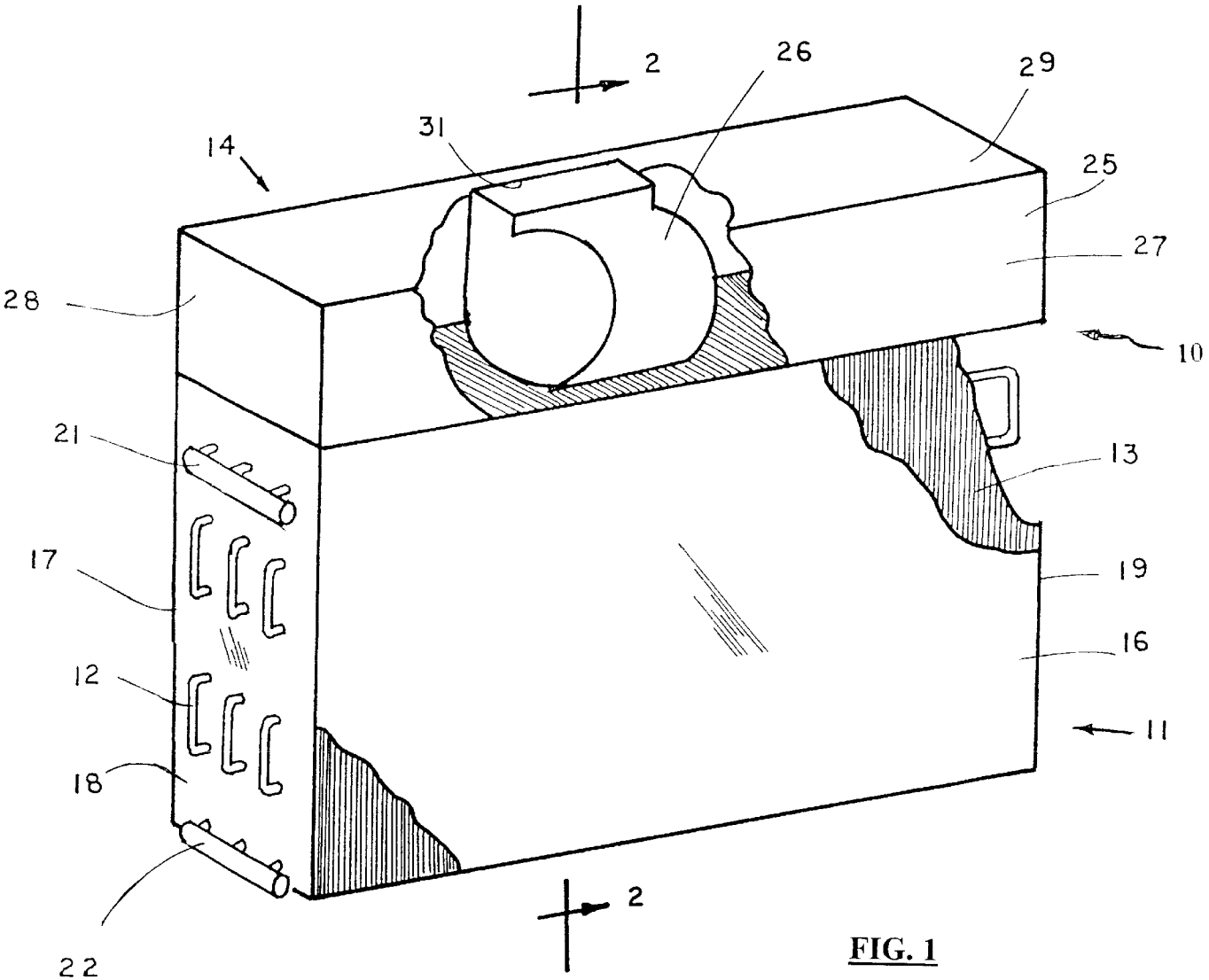
FIG. 1 is a perspective view partially in section of a heat exchanger constructed in accordance with the invention.
Figure 2:
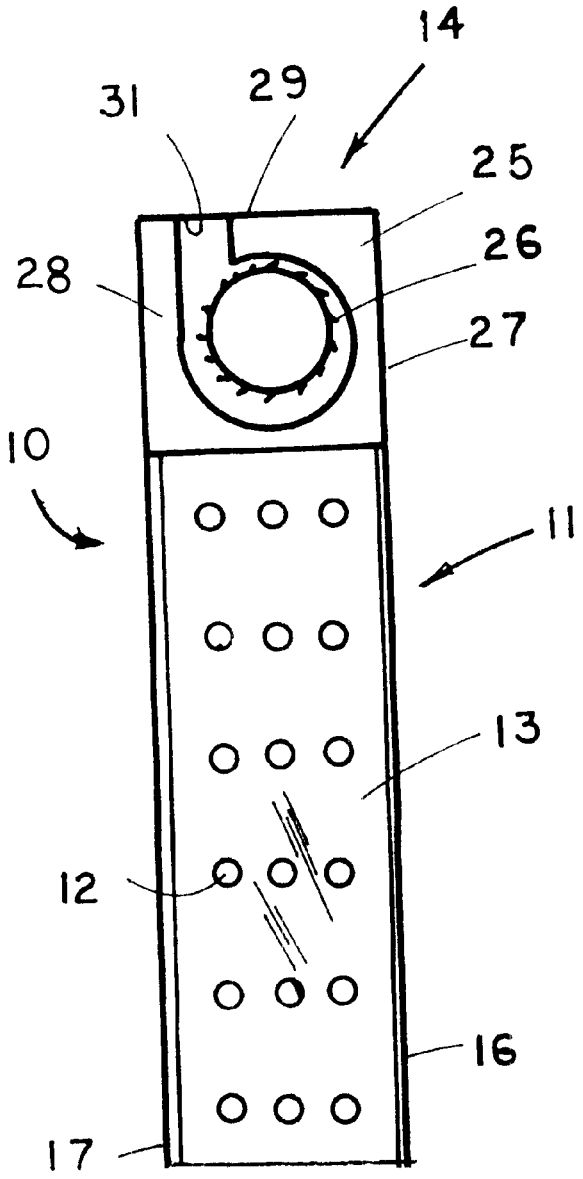
FIG. 2 is a cross sectional view of the heat exchanger shown in FIG. 1 taken along line 2—2.

Referring to FIGS. 1 and 2 of the drawings, a heat exchanger, generally designated 10, for transferring heat from fluid to air broadly includes a housing, generally designated 11, a plurality of heated fluid conducting tubes, collectively designated 12, a series of spaced parallel heat transfer fins, collectively designated 13, and a fan unit, generally designated 14.

The rectilinear housing 11 is defined by spaced front and back walls 16 and 17, respectively, and laterally spaced side walls 18 and 19, respectively, which together define an internal heat exchange chamber area (not numbered). The open top and bottom of the housing 11 provide an inlet and an outlet for the internal chamber area. The front and back walls 16 and 17 define the vertical height and horizontal width of the housing 11 and the side walls 18 and 19 define the depth of the housing 11. As seen in FIG. 1, the housing 11 has a height greater than its depth. The housing 11 has an open upper end (not numbered) from which heated air is withdrawn.

The tubes 12 extend back and forth tortuously through the tube-mounted heat transfer fins 13, which have openings therethrough corresponding to the tube shape so that the fins 13 can be mounted suitably to the tubes 13. Each of the tubes 12 has an upstream portion which communicates with a common inlet manifold 21 connected to a fluid inlet (not numbered) near the upper end of the internal chamber area and a downstream portion which communicates with a common outlet manifold 22 connected to a fluid outlet (not numbered) near the lower end of the internal chamber area. It is understood that the manifolds could be replaced by a spider, a plurality of trees, or a similar construction.

The heat transfer fins 13 are externally arranged transversely to and in heat conducting contact with the tubes 12. The heat transfer fins 13 have respective large heat transfer surfaces oriented substantially parallel to the path of air flow. While fins are typically flat, they may be corrugated, lanced, or otherwise formed or shaped to increase heat transfer. The thin fins are so spaced that the density thereof does not exceed 8 fins per inch. The tubes and fins are disposed substantially evenly and uniformly to fill the chamber area. The heat transfer fins 13 have a vertical height slightly smaller than the housing height and a horizontal depth slightly smaller than the housing depth. It is understood that relatively long fins can be replaced by multiple short fins.

The fan unit includes a compartment, generally designated 25, disposed over the open end of the housing 11 and a fan or blower, such as a squirrel cage blower 26, mounted by suitable means within the compartment 25 to move air along a substantially straight path from the upstream end to the downstream end and out of the internal chamber area. The compartment is defined by spaced front and back walls 27, laterally spaced side walls 28, and a top wall 29. Although only one blower is shown, it should be understood that a plurality of blowers may be employed as necessary for the particular application.

Each of the heated fluid conducting tubes 12 is formed in such a manner so as to have a series of spaced transversely extending straight segments perpendicular to air flow joined by U-shaped, curved segments at opposite ends thereof which connect its adjacent straight segments. All of the straight and curved segments lie in a construction plane running parallel to the direction of air flow. To insure a good counterflow effect, there are a minimum of 6 straight segments for each tube along the path of air flow. Each of the fins 13 is disposed perpendicular to the straight segments of the tubes with the flat surfaces on either side thereof lying in a plane running parallel to air flow.

It has been determined that advantageous results are obtained in heat exchangers when using relatively small diameter tubes which do not exceed ¾ inch in diameter, if the spacing between the heat transfer tubes is increased beyond the prior art maximum spacings noted hereinabove. The minimum spacing between adjacent straight segments of the heat conducting tubes 12 in a heat exchanger constructed in accordance with the present invention is shown in the following table:

| Nominal Tube Outside Diameter (inches) | Min. Tube Spacing Center to Center (inches) | Min. Tube Spacing Surface to Surface (inches) |
|---|---|---|
| ⅜ | 1.250 | .875 |
| ½ | 1.500 | 1.000 |
| ⅝ | 1.750 | 1.125 |

To summarize, the distance between the center lines of adjacent transverse tube segments, the diameter of which do not exceed ¾ inch, should be at least twice the tube diameter plus ½ inch. In other terms, the spacing between the facing exterior surfaces of adjacent transverse tube segments is at least the tube diameter plus ½ inch. This ½-inch specification would be increased to ¾ inch for higher fin densities. Because of the orientation of the heat exchanger shown in FIGS. 1 and 2, this spacing is seen as the vertical spacing between tube segments above and below each other, since air flow is from bottom to top.

It is also advantageous when the spacing between each individual fluid conducting tube 12 is increased in the same manner. As seen in FIGS. 1 and 2, there are a series of three separate tubes 12 extending upwardly from their respective downstream ends to their respective upstream ends generally along respective spaced parallel vertical planes. It is contemplated however that there may be more or fewer tubes in other embodiments of the invention. The spacing between the separate tubes 12, the diameter of which do not exceed ¾ inch, is at least the tube diameter plus ½ inch. In other terms, the distance between the planes passing through the respective center lines of side-by-side tubes 12 is at least the tube diameter plus ½ inch. This ½-inch specification would be increased to ¾ inch for higher fin densities. Because of the orientation of the heat exchanger shown in FIGS. 1 and 2, this tube spacing is seen as the horizontal spacing between adjacent tubes.

In operation, heated fluid, refrigerant or other media is delivered into the upstream portion of the tubes 12 and is withdrawn from the downstream portion of the tubes 12. Air flows through the open bottom area into the lower end of the internal chamber area, travels upwardly between and in contact with the fin surfaces for the height thereof through the open end of the housing and is then exhausted by the blower 26 through the blower outlet 31. As the air travels from the bottom of the internal chamber towards the top, the actual time it stays in contact with the surface of the fins is considerably longer than if it were to travel from the front of the fins to the rear.

In an ideal counterflow system, the temperature of the heat exchanger fluid coming out of the bottom of the coil and that of the air entering the bottom of the internal chamber will be the same. Similarly, the temperature of the air leaving the internal chamber will be the same as the fluid entering the top of the coiled tubes. This would represent nearly complete heat transfer between the hot fluid and the cooling air. The blower can then be selectively sized to move the minimum air needed for the selected application. This arrangement provides advantageous energy efficiency. Additionally, this arrangement makes the overall size and shape of the heat exchanger more compact and allows for quieter operation.

Also in this arrangement, all of the air moved is maintained in complete counterflow contact with the tubes. Therefore, the temperature of the air coming out of the heat exchanger is uniform across the surface of the outlet opening. This allows one to adjust the quantity of air moved to the minimum continuously by comparing the leaving air temperature to that of the entering fluid temperature. It is also possible to keep the amount of air moved to the minimum needed by providing an appropriately long air path. While a long air path creates excessive resistance to the air, this added resistance is reduced by using a smaller fin density. In prior art heat exchangers, both of these control means were not available. In "slab" type designs, the depth of the coil was extremely short to provide a meaningfully long air path. Additionally, the temperature of the air leaving the heat exchanger was different at different points across the coil face area—higher towards the end where hot fluid entered the coil, and gradually decreasing towards the end where the fluid was leaving the coil. Additionally, due the uneven air flow common to the slab coils, the temperature variations in leaving air temperature were further exacerbated.

Complete heat transfer with minimum air can occur only when all air moved achieves the available maximum temperature rise. All of the air moved can achieve maximum temperature rise when the air temperature approaches that of the hot fluid entering the heat exchanger. This can only happen if all of the air moved is moved over the tubes with highest fluid temperature and is given adequate time to absorb all of the heat available until temperature equalization is achieved.

Figure 3:
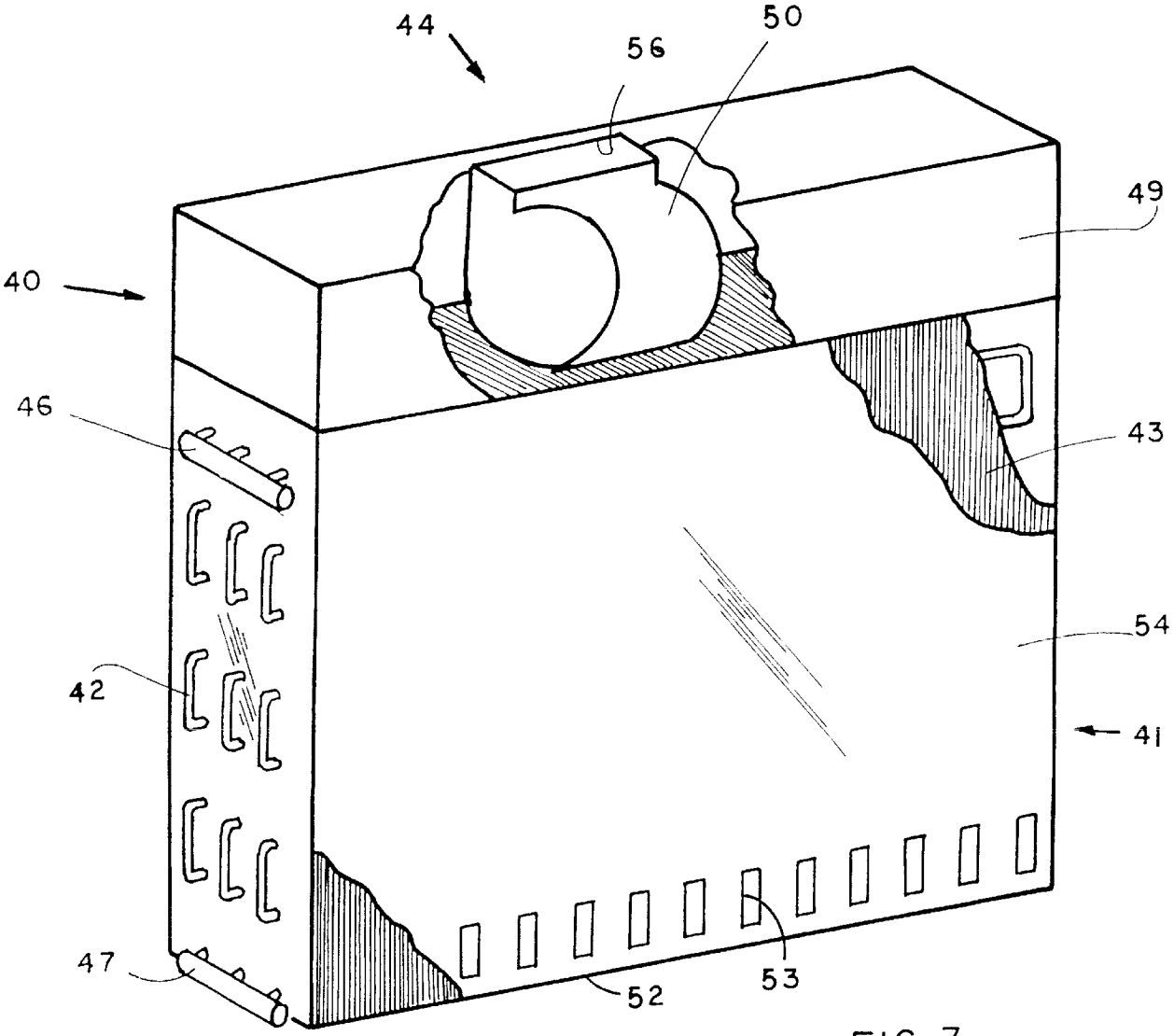
FIG. 3 is a perspective view partially in section of a second heat exchanger constructed in accordance with the invention; and, FIG. 4 is a perspective view partially in section of a third heat exchanger constructed in accordance with the invention.

In FIG. 3, a variation of the heat exchanger shown in FIGS. 1 and 2 is shown. Herein, the heat exchanger, generally designated 40, broadly includes a housing, generally designated 41, which is similar in shape to the housing shown in FIGS. 1 and 2, heated fluid conducting tubes, collectively designated 42, a horizontal series of spaced heat transfer fins, collectively designated 43, and an upper fan unit, generally designated 44. The sinuous fluid conducting tubes 42 provide communication between inlet and outlet manifolds 46 and 47, respectively, and the fan unit comprises a fan compartment 49 mounting a blower 50. The housing 41 further includes a bottom wall 52, which closes the bottom of the housing 41. A plurality of inlet openings, collectively designated 53, are defined in the lower edge portion of the front wall 54 to provide an inlet for cooling air at the lower end of the internal chamber adjacent the bottom of the heat exchanger fins 43. Air will then flow upwardly within the housing 41 and be exhausted by the blower 50 through the blower outlet 56 into the ambient atmosphere.

Figure 4:
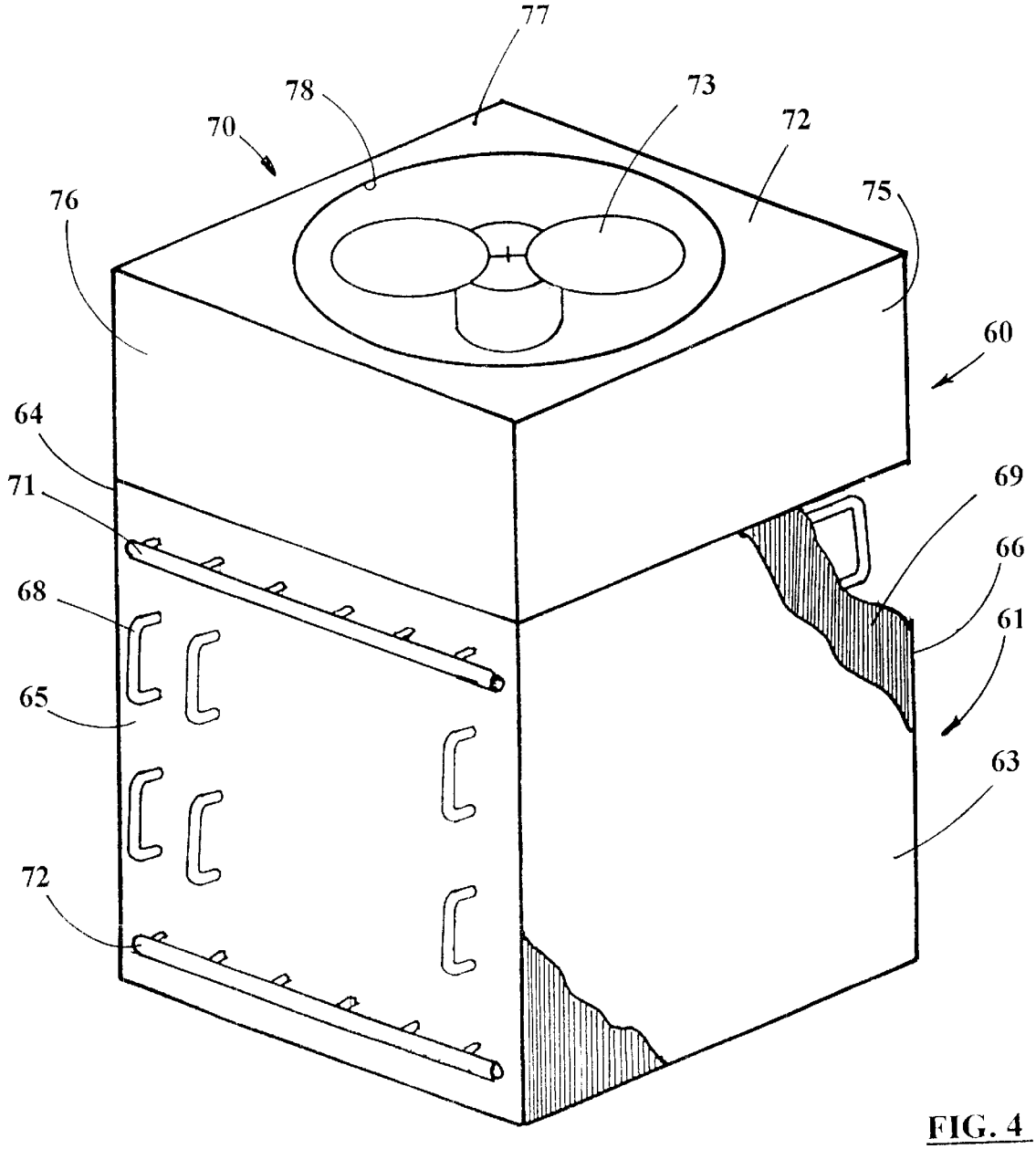

In FIG. 4, another embodiment of the heat exchanger, generally designated 60, is shown. Herein, the prior art short air path, large face area, short depth, high density fin, "slab" type, heat exchanger is transformed into a long air path, smaller face area, larger depth, low fin density, "cube" type shape.

The cube-type housing, generally designated 61, is defined by spaced front and back walls, 63 and 64, respectively, and side walls, 65 and 66, respectively. The front and back walls 63 and 64 and side walls 65 and 66 define the heat exchanger housing face area and an internal chamber area. The heat exchanger coil face area is slightly smaller than the housing face area. The housing 61 has an open upper end (not numbered) from which heated air is withdrawn. The media-conducting tubes 68 extend tortuously through the heat transfer fins 69 and have an upstream manifold inlet portion 71 which enters near the upper end of the internal chamber area and a downstream manifold outlet portion 72 which exits near the lower end of the internal chamber area.

The heat transfer fins 69 are externally arranged transversely to and in heat conducting contact with the tubes 68. The fins 69 have respective large flat surfaces oriented substantially parallel to the air path. The heat transfer fins 69 have an overall height slightly smaller than the height of the housing height and an overall width slightly smaller than the width of the housing. In this embodiment, each dimension of the length and width of the heat exchanger coil finned face area is 3 times or less than that of the length of the air path along the fins. In prior art "slab" type heat exchangers, either the length or the width of the coil face area is many times larger than the dimension of the fin along the air path, typically, 4 to 20 times.

The fan unit, generally designated 70, includes an enclosure 72 disposed over the open downstream end of the housing 61 and a fan or blower, such as propeller fan 73. The enclosure 72 is defined by spaced front and back walls 75, lateral side walls 76, and a top wall 77. The blower 73 draws air from the internal chamber and blows the air from an outlet port 78 defined in the top wall 77.

In the operation, heated fluid, refrigerant or other media is delivered into the upstream portion of the tubes 68 and withdrawn from the downstream portion of the tubes 69. Air flows through the open lower end of the internal chamber area (the air's upstream inlet), travels upwardly between and in contact with the surfaces of the fins 67 for the height thereof through the open upper end of the housing 61 (the air's downstream outlet) and is then exhausted by the blower through the blower outlet 78. As air enters the bottom and travels upward to the outlet between and in contact with the fins 67, it absorbs heat. The longer air path over a plurality of tube segments combined with counterflow allows the air to absorb more heat. In order to achieve complete heat transfer at minimum air flow, the temperature of the air leaving the housing needs to approach that of the hot fluid entering the tubes at the manifold. The air path can be lengthened suitably to accomplish this goal.

The cube-like shape makes the heat exchanger more compact. Also, it maintains the fan in close proximity to all of the coil downstream face area. This alleviates uneven flow through the coil and the resulting loss of heat transfer capacity. The smaller air velocity resulting from minimum air volume and the lesser density of the fins makes this unit quieter than those units found in the prior art.

Industrial Applicability

It can be appreciated that a heat exchanger of the type described herein can achieve maximum levels of heat exchange with increased levels of efficiency and that such levels can be achieved with a simple and low cost construction.

What is claimed is:

1. A heat exchanger for transferring heat between a heat transfer fluid and ambient air moving through the heat exchanger comprising:

a housing defined by spaced front and back walls and by spaced side walls, said housing defining an internal chamber area and upstream inlet and downstream outlet openings adjacent opposite ends of said internal chamber area with air flowing from said upstream inlet end to said downstream outlet along a substantially straight path;

a plurality of round tubes for conducting heat transfer fluid having an upstream portion and a downstream portion and extending back and forth tortuously through said chamber area, each tube having segments transverse to the air path and segments connecting adjacent transverse segments, said tube transverse segments not exceeding ¾ inch in diameter, said tube transverse segments being arranged to form at least 6 rows transverse to the air path, the distance between center lines of adjacent tube rows being at least twice the tube diameter plus ½ inch;

a series of spaced relatively thin heat transfer fins externally arranged in heat transfer conducting contact with said tubes and having respective heat transfer surfaces substantially transverse to said tubes and substantially parallel to the air path, said fins having a density not exceeding 8 fins per inch, said tubes and fins being disposed substantially evenly and uniformly to fill the chamber area; and, a fan unit disposed adjacent one end of the internal chamber to move air from said upstream end to said downstream end and out of said chamber area, whereby air in said chamber area makes contact with all transverse segments of each of said tubes thereby providing more complete heat transfer with minimal usage of said fan unit.

2. A heat exchanger for transferring heat between a heat transfer fluid and ambient air moving through the heat exchanger comprising:

a housing defined by spaced front and back walls and by spaced side walls, said housing defining an internal chamber area and upstream inlet and downstream outlet openings adjacent opposite ends of said internal chamber area with air flowing from said upstream inlet end to said downstream outlet along a substantially straight path;

a plurality of round tubes for conducting heat transfer fluid having an upstream portion and a downstream portion and extending back and forth tortuously through said chamber area, each tube having segments transverse to the air path and segments connecting adjacent transverse segments, said tube transverse segments not exceeding ¾ inch in diameter, said tube transverse segments being arranged to form at least 6 rows transverse to the air path, the distance between center lines of adjacent tube segments lying in a plane transverse to the air path being at least twice the tube diameter plus ½ inch;

a series of spaced relatively thin heat transfer fins externally arranged in heat transfer conducting contact with said tubes and having respective heat transfer surfaces substantially transverse to said tubes and substantially parallel to the air path, said fins having a density not exceeding 8 fins per inch, said tubes and fins being disposed substantially evenly and uniformly to fill the chamber area; and, a fan unit disposed adjacent one end of the internal chamber to move air from said upstream end to said downstream end and out of said chamber area, whereby air in said chamber area makes contact with all transverse segments of each of said tubes thereby providing more complete heat transfer with minimal usage of said fan unit.

3. A heat exchanger for transferring heat between a heat transfer fluid and ambient air moving through the heat exchanger comprising:

a housing defined by spaced front and back walls and by spaced side walls, said housing defining an internal chamber area and upstream inlet and downstream outlet openings adjacent opposite ends of said internal chamber area with air flowing from said upstream inlet end to said downstream outlet along a substantially straight path;

a plurality of round tubes for conducting heat transfer fluid having an upstream portion and a downstream portion and extending back and forth tortuously through said chamber area, each tube having segments transverse to the air path and segments connecting adjacent transverse segments, said tube transverse segments not exceeding ¾ inch in diameter, said tube transverse segments being arranged to form at least 6 rows transverse to the air path, the distance between center lines of adjacent tube rows being at least twice the tube diameter plus ¾ inch;

a series of spaced relatively thin heat transfer fins externally arranged in heat transfer conducting contact with said tubes and having respective heat transfer surfaces substantially transverse to said tubes and substantially parallel to the air path, said tubes and fins being disposed substantially evenly and uniformly to fill the chamber area; and, a fan unit disposed adjacent one end of the internal chamber to move air from said upstream end to said downstream end and out of said chamber area, whereby air in said chamber area makes contact with all transverse segments of each of said tubes thereby providing more complete heat transfer with minimal usage of said fan unit.

4. A heat exchanger for transferring heat between a heat transfer fluid and ambient air moving through the heat exchanger comprising:

a housing defined by spaced front and back walls and by spaced side walls, said housing defining an internal chamber area and upstream inlet and downstream outlet openings adjacent opposite ends of said internal chamber area with air flowing from said upstream inlet end to said downstream outlet along a substantially straight path;

a plurality of round tubes for conducting heat transfer fluid having an upstream portion and a downstream portion and extending back and forth tortuously through said chamber area, each tube having segments transverse to the air path and segments connecting adjacent transverse segments, said tube transverse segments not exceeding ¾ inch in diameter, said tube transverse segments being arranged to form at least 6 rows transverse to the air path, the distance between center lines of adjacent tube segments lying in a plane transverse to the air path being at least twice the tube diameter plus ¾ inch;

a series of spaced relatively thin heat transfer fins externally arranged in heat transfer conducting contact with said tubes and having respective heat transfer surfaces substantially transverse to said tubes and substantially parallel to the air path, said tubes and fins being disposed substantially evenly and uniformly to fill the chamber area; and, a fan unit disposed adjacent one end of the internal chamber to move air from said upstream end to said downstream end and out of said chamber area, whereby air in said chamber area makes contact with all transverse segments of each of said tubes thereby providing more complete heat transfer with minimal usage of said fan unit.

* * * * *